US006164200A

United States Patent [19]

Mathea

[11] Patent Number: 6,164,200

[45] Date of Patent: Dec. 26, 2000

[54] APPARATUS FOR IMPRINTING AN UNMARKED ENDLESS FOIL

[75] Inventor: Hans Mathea, Eggenstein-Leopoldshafen, Germany

[73] Assignee: Gesellschaft für Computer Systeme und Automationstechnik mit beschränkter Haftung, Eggenstein-Leopoldshafen, Germany

[21] Appl. No.: 09/431,570

[22] Filed: Oct. 29, 1999

[30] Foreign Application Priority Data

Oct. 31, 1998 [DE] Germany ..... 198 50 275

[51] Int. Cl.[7] ..... B41F 13/56

[52] U.S. Cl. ..... 101/227

[58] Field of Search ..... 101/227

[56] References Cited

U.S. PATENT DOCUMENTS 5,099,290 3/1992 Yokota ..... 355/310
5,464,289 11/1995 Beaudry ..... 400/62
5,711,225 1/1998 Rasmussen ..... 101/483
5,765,481 6/1998 Tortora et al. ..... 101/211
5,964,151 10/1999 Mathea ..... 101/227

*Primary Examiner*—John S. Hilten
*Assistant Examiner*—Charles H. Nolan, Jr.
*Attorney, Agent, or Firm*—Klaus J. Bach

[57] ABSTRACT

In an apparatus for imprinting an unmarked endless foil with images which are to be arranged within sections of the foil of a predetermined length L including a printing device, a transport device with a foil section indicator provides a signal to a control unit to determine section limits and a buffer arrangement including a first foil movement sensor sensing the movement of the foil from the printer and a second foil movement sensor sensing the foil movement into the transport device is arranged between the printing device and the transport device and the control device to which the first and second foil movement sensors are connected compares the signals and supplies a printing initiation signal when the length of the endless foil between a section limit provided by the foil section indicator and the printing device is a predetermined multiple of the length of the section L.

7 Claims, 1 Drawing Sheet

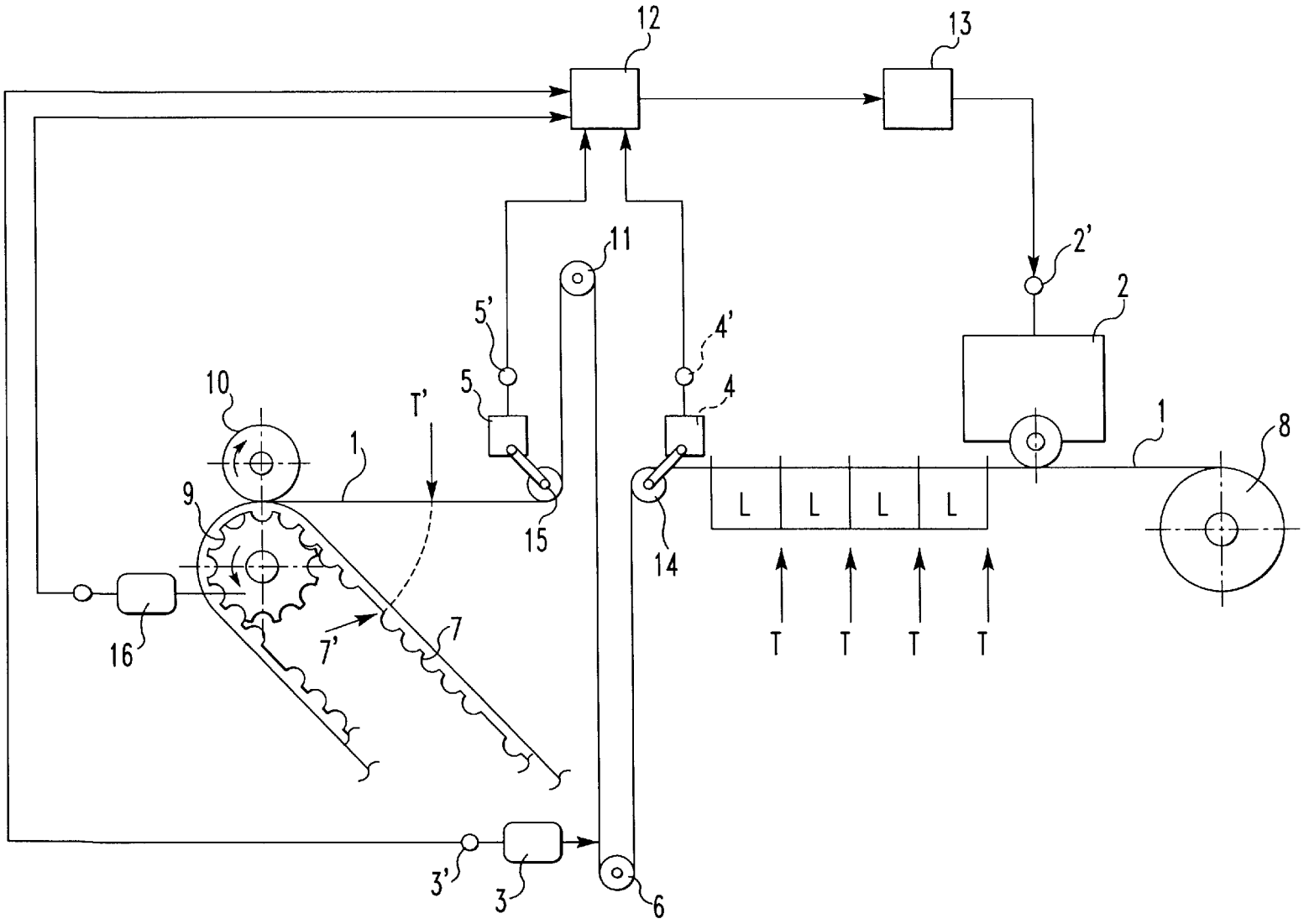
8
1
2
2'
13
L
L
L
L
T
T
T
T
4'
4
14
12
11
6
15
5'
5
3
3'
T'
7
7'
1
10
9
16

APPARATUS FOR IMPRINTING AN UNMARKED ENDLESS FOIL

BACKGROUND OF THE INVENTION

The invention relates to an apparatus for imprinting images on an endless foil such that they are disposed on a section of predetermined length L by a printing device through which the foil is continuously moved, as the endless foil is directed to a transport element, which divides the foil into the sections of the predetermined length and after which the endless foil is cut into sections of the predetermined length L. The print images need to be accurately disposed within the limits between two adjacent sections of the endless foil and the printing device is activated individually for the printing of each printing image when the length of the endless foil between a section limits generated by the last sectioning and the printing device is a predetermined multiple of the predetermined length L. A buffer arrangement for the endless foil is also provided.

An endless foil printing apparatus is known for example from Applicant's U.S. Pat. No. 5,964,151.

The known apparatus is preferably used when so-called blister packs, in which for example pills are disposed, are to be provided with accurately positioned print images. The pills are always disposed in pockets of a deep drawn blister foil of plastic or paper which are sealed by a cover foil. The cover foil is provided with a print image for the identification of the pills including data regarding the use of the individual pills. It is therefore important that the data are accurately located on the cover foil in accordance with the location of the pills or respectively, the corresponding pockets. Any mismatch between the position of the blister foil and the cover foil should be minimal that is there should be no noticeable mismatch.

With the known apparatus the cover foil can be applied to the blister foil with high accuracy. This is achieved essentially by the fact that the beginning of a foil section to be imprinted is constantly re-determined. By the constant redetermining of the beginning of the section to be imprinted errors are not added up. As a result, even relatively large deviations are generally not detrimental since a deviation in one section does not affect the position of the printing image on the next section. Also, slippage of the foil does not affect the subsequent image positions.

The known apparatus is particularly advantageous if the sections are removed from the apparatus in a discontinuous manner, since the signal activating the printing device to imprint only a single image is generated by a sensor when a compensation roller is disposed in a predetermined position. With the discontinuous removal of the imprinted foil, the compensation roller moves a certain distance along a given path, that is, its position changes dependent on the length of the foil between the printing device and the removal device so that the compensation roller is very suitable for generating a foil length-dependent signal.

If a foil is to be removed from the apparatus in a continuous manner, the apparatus covered by Applicant's earlier patent is not suitable. With the continuous removal of the foil the locations of the section limits move constantly so that the position of the compensation roller cannot be used as a measure for the length of the endless foil between the printing device and the section limit provided by the respective last sectioning.

It is therefore the object of the present invention to provide an apparatus in which the printing images are accurately individually located on an endless foil even if the foil is continuously removed from the apparatus.

SUMMARY OF THE INVENTION

In an apparatus for imprinting an unmarked endless foil with images which are to be arranged within sections of the foil of a predetermined length L including: a printing device, a transport device with a foil section indicator provides a signal to a control unit to determine section limits and a buffer arrangement including a first foil movement sensor sensing the movement of the foil from the printer and a second foil movement sensor sensing the foil movement into the transport device is arranged between the printing device and the transport device, and the control device to which the first and second foil movement sensors are connected compares the signals and supplies a printing initiation signal when the length of the endless foil between a section limit provided by the foil section indicator and the printing device is a predetermined multiple of the length of the section L.

If the difference between the movements sensed by the foil movement sensors is zero the length of the foil section supplied to the buffer structure is the same as the length of the foil section removed from the buffer structure. This again means that the speed with which the endless foil was moved by the transport element is exactly the same as the speed with which the endless foil is moved through the printing device. As a result, the length of the endless foil between the section limit generated by the last sectioning step and the printing device has not changed and is still the predetermined multiple of the predetermined length L.

If the speed with which the endless foil is moved through the printing device differs from the speed with which the endless foil is moved through the transport device, the difference of the foil length sensed by the movement sensors is different from zero. If the endless foil moves through the printing device at a speed lower than that of the transport device a signal which is generated by the transport device after the movement of the endless foil by the predetermined length, if uncorrected, would activate the printing step too early. Consequently, the signal must be delayed in accordance with the difference between the foil movement lengths sensed by the movement sensors. With the appropriate delay the imprint is initiated exactly at the point when the length of the endless foil between the printing device and the section limit provided by the last sectioning is exactly the predetermined multiple of the predetermined length L.

With the apparatus according to the invention, it is therefore possible to correct an error caused by a foil moving speed through the printing device, which is too low. This is the most often occurring error. Also, the printing device may be so designed that this error will generally occur. Then the apparatus can fulfill the requirements, that is, it can adjust the speed of the foil moving through the carrier element.

An error caused by an excess foil movement speed in the printing device can be corrected if the signal transmission line for the activation of the printing device includes a storage acting as an idling unit, as it is provided for a particular embodiment of the apparatus according to the invention. With this arrangement, the signal activating the printing device can be delayed. The signal generated by the transport element is first supplied to the storage. Here, the signal which is to activate the printing device can be timed so that it is delayed but it may also be advanced. By an advancement of the point in time when the signal is to activate the printing device an excess transport speed of the printing device can be corrected in an advantageous manner. Of course, the storage acting as idle time unit can be so designed that the signal activating the printing device is transmitted to the printing device delayed by two or several time segments.

In another embodiment of the apparatus according to the invention, the buffer arrangement includes a compensating roller which is arranged movably in such a way that the position of the compensating roller at the time a signal is provided by the transport device depends on the length of the endless foil between the section limit provided by the most recent sectioning and the printing device. The position of the compensating roller is detected by a sensor. If the sensor is so arranged that it will provide a signal or a signal change exactly when the length of the foil between the section limits generated by the most recent sectioning and the printing device is a multiple of the predetermined length L, the signal or, respectively, the signal change can be used for the setback of the difference generated by the two foil movement sensors to zero.

In this way, a slippage occurring between the foil and the foil transport device can be corrected in an advantageous manner. The signal for the activation of the printing device generated by the transport device is generated on the basis of the movement of the transport device drive, not on the basis of the movement of the foil. As a result, the signal is generated when the transport device drive has moved by an amount corresponding to the predetermined length L even if the foil movement is lagging because of slippage and has not been moved fully by the predetermined length.

In a particular embodiment of the apparatus according to the invention, an offset roller is provided by way of which the length of the endless foil between the section limit generated by the respective last sectioning and the printing device can be changed. This is advantageous if the format of the print image or of the section to be imprinted is changed, since, then the length of the endless foil between the section limit and the printing device must be changed. In order to be able to leave the position of the compensating roller unchanged in spite of the change in length between the section limit provided the last sectioning and the printing device, the offset roller is displaced such that the length of the endless foil between the transport device and the printing device is again a predetermined multiple of the second, now changed, predetermined length L when the compensation roller is in the position in which the sensor provides a signal or a change of the output signal occurs. In this way, the position of the printing device does not need to be changed if the section length is changed.

In another embodiment of the apparatus according to the invention, a control arrangement is provided by which the transport speed of the endless foil through the printing device is so controlled that the difference between the movement lengths sensed by the rotation sensors is minimal. In this way, the errors to be corrected are held at a minimum.

Further features and advantages of the apparatus according to the invention will become apparent from the following description of a particular embodiment on the basis of the accompanying drawing.

BRIEF DESCRIPTION OF THE DRAWING

The sole FIGURE is a schematic representation of the arrangement of the printing apparatus according to the invention.

DESCRIPTION OF A PREFERRED EMBODIMENT

The FIGURE shows a printing apparatus wherein an endless foil 1 to be imprinted is unrolled from a roll 8 and is then moved through a printing device 2. After the printing device 2, the endless foil 1, which generally consists of aluminum, is guided around a first redirecting roller 14. After the first redirecting roller 14, the endless foil 1 extends around a compensation roller 6 and an offset roller 11 in an S-shaped travel pattern. The compensation roller 6 and the offset roller 11 are disposed in the bases of the loops, which are formed by the endless foil 1. After the offset roller 11, the endless foil is guided around a second redirecting roller 15 the foil 1 passes through a transport device consisting of a blister roller 9 and a seal roller 10 for moving the endless foil 1.

A deep drawn blister foil 7 of plastic or paper extends around the blister roller 9. At its circumference, the blister roller includes recesses, which receive pockets formed into the blister foil 7. Pills, for example, may be disposed in those pockets. The pockets are arranged in groups of several pockets. The beginning of a group is indicated in the FIGURE by the reference numeral 7'. The seal roller 10 is heated and presses the endless foil 1 onto the blister roller 9. In this way, the endless foil 1 is attached to the blister foil 7. The endless foil 1 must be accurately positioned on the blister foil 7 such that the image imprinted on the endless foil 1 is properly disposed on the pockets including the respective pill or pills.

Adjacent the blister roller 9, a sensor 16 is arranged, which generates an impulse when the beginning of a group of pockets formed into the deep draw foil 7 is at a predetermined location. With the signal, the endless foil 1 is divided into sections of a predetermined length L. The length L of a section of the endless foil 1 accordingly corresponds to the part of the endless foil 1, which was transported through the blister roller 9 and the seal roller 10 in the time period between two signals provided by the sensor 16. The signal of the sensor 16 is transmitted to a control unit 12.

The compensation roller 6 and the offset roller 11 are so arranged that they can be moved toward, and away from, each other. While the offset roller 11 is lockable, the compensation roller 6 is freely movable. The compensation roller 6 and the offset roller 11 accordingly form an arrangement for buffering the endless foil 1. By an adjustment of the offset roller 11, the length of the endless foil 1 between the start 7' of a group of pockets formed in the blister foil 7 and the printing device 2 at the point in time when the sensor 16 generates the signal can be adjusted. Such adjustment is necessary when the predetermined length L is changed.

The first redirecting roller 14 is provided, with a first rotation sensor 4. At the output 4' of the first rotation sensor 4 a signal is provided which is proportional to the rotational movement of the first redirecting roller 14. The second redirecting roller 15 is provided with a second rotation sensor 5. At the output 5' of the second rotation sensor a signal is provided which is proportional to the rotational movement of the second redirecting roller 15.

In the neighborhood of the compensation roller 6, an optical sensor 3 is so arranged that a signal generated thereby and available at its output 3' changes when the length of the foil 1 at the time of the signal generation of the transport elements 9, 10 between the section limit T' just generated and the printing device 2 is a predetermined multiple of the given length L.

The output 4' of the first rotation sensor 4, the output 5' of the second rotation sensor 5 and the output 3' of the compensation roller position sensor 3 are connected to the control unit 12, which generates the difference between the output signals of the two rotation sensors 4, 5. The output of the control unit 12 is connected to a storage 13 forming an idling member. The output of the storage 13 is connected to an input 2' of the printing device 2 for activating the printing device 2. The storage 13 can be set up in such a way that the difference signal provided by the control unit 12 is zero when the first rotational sensor 4 has supplied a number of signals to the control unit 12 corresponding exactly to one or two sections in excess of the number of signals provided by the second rotational sensor 5. In this way, the signal for the activation of the printing device 2 supplied by the control unit 12 is delayed exactly by one or respectively, two sections. Such solution can be established particularly easily by software.

Below, the operation of the apparatus according to the invention will be described.

The blister foil 7 is moved by rotation of the blister foil roller 9. When the start 7' of a group of pockets formed in the blister foil 7 is at a predetermined location the sensor 16 of the blister foil roller 9 generates a signal. This signal is supplied to the control unit 12 where it is corrected in accordance with data supplied by the first and second rotation sensors 4 and 5. The buffer arrangement consisting of the offset roller 11 and the compensation roller 6 is so designed that the length of the endless foil 1 between the start 7' of a group of pockets in the blister foil when sensed by the sensor 16 and the printing device 2 is a predetermined multiple of the predetermined section length L. In this position, the difference of the output signals of the rotation sensors 4 and 5 formed by the control unit 12 is zero. The signal from the sensor 16 of the blister foil roller 9 is therefore supplied to the input 2' of the printing device 2 in an uncorrected fashion for activating the printing device. As a result, the printing process starts exactly at the start of a section of the predetermined length L.

If the foil movement speed through the printing device 2 is lower than the speed with which the endless foil 1 is moved through the transport unit formed by the blister foil roller 9 and the seal roller 10, the signal generated by the sensor 16 of the blister foil roller 9 occurs before the start of a section to be imprinted is in the appropriate position in the printing device 2. The printing process must therefore not be activated when the sensor 16 of the blister foil roller 9 generates the signal.

Since the transport speed of the printing device 2 is lower than that of the transport elements 9, 10, the output (speed) signal of the rotation sensor 4 is lower than that of the rotation sensor 5. The difference serves as an indication for the length of the endless foil 1, which was transported through the transport element 9, 10, but not through the printing device 2. The control unit 12 delays the signal supplied by the sensor of the blister foil roller 9 by a time period corresponding to the difference so that the impulse supplied to the input 2' of the printing device 2 activates the printing device 2 exactly when the beginning of a section to be imprinted is in the position as required for the printing process.

If the transport speed of the printing device 2 is higher than the transport speed of the transport elements 9, 10, the storage 13 acting as an idle time member becomes effective. In the storage 13, the impulse as supplied by the control unit 12 is then delayed by a section length. In this way, it is possible not only to time-delay the signal supplied by the control unit 12 in the storage 13, but also to advance the signal. In accordance with the signal supplied by the control unit 12, the impulse supplied to the input 2' of the printing device 2 can activate the printing device at a time at which the sensor 16 of the blister foil roller 9 has not yet generated the signal (by using the appropriately delayed previous signal).

The sensor 3 is so positioned that, based on the position of the compensating roller 6, a signal change is provided when the length of the endless foil 1 between the section limit T' just determined and the printing device 2 corresponds to a predetermined multiple of the predetermined length L. If at the time of a signal change of the sensor 3 because of slippage the difference between the output signals of the sensors 4 and 5 should not be zero, the difference is reset in the control unit 12 to zero when the signal change of the sensor 3 occurs. In this way, a slippage error is constantly corrected. Furthermore, the output signal of the sensor 3 can be used to determine whether the transport speed of the printing device 2 is higher or lower than the transport speed of the transport unit 9, 10.

Although the sensor 3 used in the described embodiment is an optical sensor, another type of sensor such as an electronic distance or proximity sensor may be used. Instead of a signal change, the control unit 12 would then have to evaluate a distance value. With an electronic distance sensor, a mechanical adjustment of the sensor 3 could be avoided since adjustments for changes in the length L could be made by changing the distance instructions in the control unit 12 or the calculation basis.

In that case, also the offset roller 11 could be eliminated since length changes of the endless foil 1 could be taken into consideration by the control unit 12.

What is claimed is:

1. An apparatus for imprinting an unmarked endless foil with images which are to be arranged within sections of the foil of a predetermined length L, comprising: a printing device arranged at the beginning of the path of said endless foil through said apparatus through which said endless foil moves continuously and in which an image is imprinted centered onto each section of said endless foil, a device for cutting said endless foil into sections of said predetermined length L arranged at the end of said path of said endless foil through said apparatus for cutting said foil at a section limit, a transport device receiving said endless foil from said printing device, a foil section sensor associated with said transport device for sensing movement of said foil through said transport device and providing a signal each time a section length L of said foil has passed through said transport device, a buffer arrangement disposed in the path of said endless foil between said printing device and said transport device and including a first foil movement sensor at the entrance to said buffer arrangement and a second foil movement sensor at the exit of said buffer arrangement, a control device receiving the signal from said foil section sensor and generating a printing signal which is supplied to said printing device to initiate printing of said image onto the foil section in said printing device, said control device also receiving the signals generated by said first and second foil movement sensors and comparing the two signals to determine therefrom any difference in the movement of said endless foil leaving the printing device and the movement of said endless foil through said transport device for a correction of the printing signal supplied to said printing device, said printing signal being supplied to said printing device when the length of the endless foil between said section limit and said printing device is a predetermined multiple of said section length L.

2. An apparatus according to claim 1, wherein said printing signal is supplied from said control device to said printing device by way of a signal line and said signal line includes a signal storage device.

3. An apparatus according to claim 1, wherein said buffer arrangement includes a compensation roller around which a loop of said endless foil extends, said compensation roller being movably supported so as to accommodate an increasing and decreasing loop caused by a difference of the endless foil movement through said printing device and through said transport device and a compensation roller position sensor arranged so as to detect the position of said compensation roller which depends on the length of the endless foil between a section limit as detected by said foil section sensor and said printing device.

4. An apparatus according to claim 3, wherein said buffer arrangement includes an offset roller around which said endless foil also extends and said offset roller is adjustably supported so as to permit adjustment of the length of said endless foil between said foil cutting device and said printing device.

5. An apparatus according to claim 3, wherein said compensation roller position sensor is so arranged that it generates a signal when the length of said endless foil between said section limit as determined by said foil section sensor and said printing device is a predetermined multiple of said section length L.

6. An apparatus according to claim 5, wherein said difference of foil movement as sensed by said first and second foil movement sensors is set to zero with each signal generated by said compensation roller position sensor.

7. An apparatus according to claim 1, wherein the speed of movement of said endless foil through said printing device is controlled such that the difference of foil movement as sensed by said first and second foil movement sensors is at a minimum.

* * * * *